United States Patent [19]

Coehoorn et al.

[11] Patent Number: 4,810,309

[45] Date of Patent: Mar. 7, 1989

[54] METHOD OF MANUFACTURING FLAKES FROM A MAGNETIC MATERIAL HAVING A PREFERRED CRYSTALLITE ORIENTATION, FLAKES AND MAGNETS MANUFACTURED THEREFROM

[75] Inventors: Reinder Coehoorn; Dionysius J. Duisters, both of Eindhoven, Netherlands

[73] Assignee: U.S. Philips Corporation, New York, N.Y.

[21] Appl. No.: 96,178

[22] Filed: Sep. 11, 1987

[30] Foreign Application Priority Data

Sep. 17, 1986 [NL] Netherlands ..... 8602349
Aug. 7, 1987 [NL] Netherlands ..... 8701860

[51] Int. Cl.[4] ..... B22D 11/06; B22F 9/08

[52] U.S. Cl. ..... 148/302; 164/463; 75/251; 428/606

[58] Field of Search ..... 164/462, 463, 479, 485, 164/46, 480; 148/302; 75/251; 428/606

[56] References Cited

FOREIGN PATENT DOCUMENTS 61-10208 1/1986 Japan .

OTHER PUBLICATIONS

"Permanent Magnet Properties of Rapidly Quenched Rare Earth-Iron Alloys", by J. J. Croat, Physics Department, GM Research Laboratories, Research Publication GMR-4080.

*Primary Examiner*—Kuang Y. Lin
*Attorney, Agent, or Firm*—Norman N. Spain

[57] ABSTRACT

A method of manufacturing flakes from hard magnetic material having a preferred orientation of crystallites is described, in which the cooling rate of a molten alloy which comprises a rare earth metal, iron and/or cobalt and boron is chosen to be so that the flakes have an average length of 10 mm and a thickness of between 10 and 70 μm.

5 Claims, No Drawings

METHOD OF MANUFACTURING FLAKES FROM A MAGNETIC MATERIAL HAVING A PREFERRED CRYSTALLITE ORIENTATION, FLAKES AND MAGNETS MANUFACTURED THEREFROM

BACKGROUND OF THE INVENTION

The invention relates to a method of manufacturing flakes from a magnetically hard material by spraying a molten alloy which comprises at least a rare earth metal, at least a transition metal from the group consisting of iron and cobalt, and boron on a rapidly moving cooling surface, a magnetically hard finely crystalline phase being formed in the solidified alloy.

Flakes are to be understood to mean in this connection relatively short pieces of a metal foil of a small thickness having a length which may be a few times larger than their width.

The invention also relates to flakes of a magnetically hard material of the said composition and to magnets manufactured from flakes according to the invention.

A method of manufacturing a magnetically hard material in the form of a ribbon is known from European Patent Application EP-A 108 474. The moving cooling surface in the known method is formed by the circumferential surface of a disc of a material having a high thermal conductivity, for example copper, covered with chromium.

It is stated on pages 47 and 48 of this European Patent Application that the optimum magnetic domain dimension is approximately 40 to 50 nanometers (0.04–0.05 μm). Alloys with crystallites having dimensions between approximately 20 and 400 nanometers show permanent magnetic properties. The ribbons are magnetically isotropic. This appears from the fact that the ribbons show the same magnetizability in all directions. It is suggested in the European Patent Application that a preferred orientation of the crystallites might result in improved magnetic properties. However, this European Patent Application does not give any indication as to how such a preferred orientation could be realised.

From the published Japanese Patent Application (Kokai) No. 61-10208 a method of manufacturing permanent magnets from the said metals is known, in which in a first step thin ribbons are manufactured by spraying molten metal on a moving cooling surface. In a second step, involving the application of heat, a laminated body is manufactured from the ribbon obtained in the first step.

In the first step of this method thin ribbons are obtained by employing a certain method of cooling, in which crystals are present whose c-axis is perpendicular to the surface of the ribbon.

With respect to the method of cooling it is only indicated that the rate of movement of the cooling surface must be from 3–20 m/s. From the exemplary embodiments it appears that coherent ribbons having a thickness of 100 μm are manufactured which may be divided into parts having a length of 10 mm each.

In the second step of this method a permanent magnet having suitable properties is obtained by heating (600°–1100° C.) under pressure (2 tons/cm$^2$). This heating under pressure is essential for obtaining a high-energy product (BH max).

In the investigations leading to the invention it has been found that when in the known method ribbons of a greater length and having a thickness of 100 μm are manufactured, orientation of the c-axis perpendicularly to the surface of the ribbon occurs, mainly in a thin layer on the side of the ribbon which during the manufacture of the ribbon did not contact the cooling surface (free side).

SUMMARY OF THE INVENTION

It is an object of the present invention to provide a method by which magnetically anisotropic flakes can be manufactured, in which the crystallites are preferentially oriented not only on the free side but through at least a very substantial part of the thickness, the crystallographic c-axis being perpendicular to the surface of the flakes.

It was found that this object can be achieved by a method of the kind described, which is characterized in that the molten alloy is cooled, thereby forming flakes having an average length of 10 mm and a thickness between 10 and 70 μm. The resulting preferred orientation produces a magnetic anisotropy of the flakes formed (i.e. there is a preferred direction of magnetisation). The volume fraction of preferentially oriented crystallites is largest on the free side of the flakes, where the cooling rate was comparatively the lowest, and is smallest on the wheel side of the flakes, where the cooling rate was comparatively the highest.

DETAILED DESCRIPTION OF THE INVENTION

The required thickness and dimensions of the flakes and the degree of orientation can be controlled by a suitable choice of the rate of supply of the molten alloy and of (a) the rate of movement of the cooling surface; here it holds that the lower the rate the larger are the crystallites formed;

(b) the substrate material on which the cooling surface is present; for this it holds that the smaller the heat dissipation per time unit the larger are the crystallites formed; for example the thermal conductivity, thermal capacity and surface roughness are the decisive factors;

(c) the protective gas: the thermal conductivity of the gas in the cavities between the wheel and the flakes also determines the cooling rate.

For a given choice of the parameters mentioned, the dimension of the crystallites can also be increased by increasing the quantity of molten alloy applied to the cooling surface. The quantity applied must, however, remain below the quantity at which ribbons of larger lengths and thicknesses are formed.

By varying the indicated parameters it is possible in practice by means of a limited number of experiments to establish the optimum conditions for reaching the desired crystallite size in the flakes, with a view also to the coercive force and the magnetic energy product to be achieved.

For the manufacture of anisotropic magnets the flakes are used without pulverising or grinding them. The flakes are compressed and sintered, it being ensured that the flakes become located parallel to each other as much as possible in the magnet body formed. This can be achieved, for example, by vibrating them in a suitable mould. The parallel flakes may also be bonded by means of a synthetic resin and be formed into a magnet.

Exemplary embodiment:

20 g of an alloy on the basis of neodymium, iron and at least one transition element selected from the group consisting of cobalt and boron were melted by heating at approximately 1300° C. The liquid metal was sprayed through an aperture of 10×0.4 mm onto a rapidly rotating copper wheel. The distance between the spray aperture and the wheel was 200 μm. Spraying was carried out in an argon atmosphere at an outflow rate of 7.5 $cm^3/s$, an argon atmosphere has a smaller thermal conductivity than, for example, helium and neon. The wheel diameter was always 60 cm. In the spraying process flakes are formed. The wheel was rotated at a rate of 450 rpm. The wheel consisted of copper (not coated with another metal) but may alternatively be of steel.

Preferably, there is started from an alloy composition which with respect to the stoichiometric composition $Nd_2Fe_{14}B$ comprises a small excess of neodymium and/or boron. Suitable compositions are represented by the general formula:

$$RE_x(Fe, Co)_yB_z$$

where
x=0.11–0.16
y=0.77–0.84
z=0.05–0.11,
and where
x+y+z=1,
and
RE stands for one or more rare earth metals and/or yttrium.

Such as for example $Nd_{15}Fe_{77}B_8$, $Nd_{13,3}Fe_{79,4}B_{7,3}$, $Nd_{13,5}Fe_{79,6}B_{6,9}$ and $Nd_{13,5}Fe_{81}B_{5,5}$. In particular a boron concentration which is slightly higher than that in the stoichiometric composition stimulates a preferential orientation of the crystallites in the desired sense. The flakes formed generally were approximately 10 mm wide and 30 to 100 micrometers thick and averagely 10 mm long. The flakes formed were magnetically anisotropic and comprised crystsallites which were oriented with the c-axis substantially perpendicular to the surface.

We claim:

1. A method of manufacturing flakes of a magnetically hard material by spraying a molten alloy which comprises at least one rare earth metal, at least one transition metal selected from the group consisting of iron and cobalt, and boron, on a moving cooling surface, a magnetically hard finely crystalline phase being formed in the solidified alloy, characterized in that the molten alloy is solidified on said cooling surface thereby forming flakes having an average length of 10 mm and a thickness between 10 and 70 μm and formed of crystallites which are preferentially oriented with their crystallograph c-axis perpendicular to the surface of the fakes starting from the side of the flakes that was away from the cooling surface through at least a very substantial portion of the thickness of the flakes.

2. A method as claimed in claim 1, characterized in that a molten alloy is used whose composition is represented by the general formula $RE_x(Fe, Co)_yB_z$, where
x=0.11–0.16
y=0.77–0.84
z=0.05–0.11,
and where
x+y+z=1,
and
RE is at least one element selected from the group consisting of the rare earth metals and yttrium.

3. A method as claimed in claim 2, characterized in that RE=Nd.

4. A magnet formed from flakes produced by a method as claimed in claim 3.

5. Flakes of an average length of 10 mm and a thickness of between 10 and 70 μm consisting of a magnetically hard material which comprises at least a rare earth metal, at least a transition metal from the group formed by iron and cobalt, and boron, characterized in that the flakes are manufactured by spraying a molten alloy on a rapidly moving cooling surface, and in that the flakes are magnetically anisotropic and comprise preferentially oriented crystallites in the flakes which are directed with their crystallographic c-axis perpendicular to the surface of the flakes starting from the surface of the flakes that was away from the cooling surface and through at least a very substantial portion of the thickness of the flakes.

* * * * *